US009435304B2

(12) United States Patent
Fisher et al.

(10) Patent No.: US 9,435,304 B2
(45) Date of Patent: Sep. 6, 2016

(54) DIESEL FUEL PUMP MODULE

(71) Applicant: Robert Bosch GmbH, Stuttgart (DE)

(72) Inventors: Paul E. Fisher, Brighton, MI (US); Paul Mason, Dearborn, MI (US); Charles Newell, III, Bloomfield Twp., MI (US)

(73) Assignee: Robert Bosch GmbH, Stuttgart (DE)

( * ) Notice: Subject to any disclaimer, the term of this patent is extended or adjusted under 35 U.S.C. 154(b) by 397 days.

(21) Appl. No.: 13/973,334

(22) Filed: Aug. 22, 2013

(65) Prior Publication Data

US 2014/0053814 A1 Feb. 27, 2014

Related U.S. Application Data

(60) Provisional application No. 61/693,592, filed on Aug. 27, 2012.

(51) Int. Cl.

| | |
|---|---|
| ***F02M 37/04*** | (2006.01) |
| ***F02M 39/02*** | (2006.01) |
| ***F02M 37/10*** | (2006.01) |
| ***F02M 37/20*** | (2006.01) |

(52) U.S. Cl.

CPC ..... *F02M 39/02* (2013.01); *F02M 37/106* (2013.01); *F02M 37/20* (2013.01)

(58) Field of Classification Search

CPC .. F02M 37/106; F02M 37/103; F02M 37/10; F02M 2037/225; F02M 37/14; F02M 35/0223; F02M 37/221; B01D 35/26; B60K 2015/0325

USPC ..... 123/497, 509, 516, 518; 95/261

See application file for complete search history.

(56) References Cited

U.S. PATENT DOCUMENTS

| | | | | |
|---|---|---|---|---|
| 4,162,901 A | | 7/1979 | Enegess | |
| 4,269,607 A | | 5/1981 | Walker | |
| 4,367,078 A | | 1/1983 | Hendrix | |
| 4,664,088 A | * | 5/1987 | Cantoni | F02M 37/22 123/557 |
| 4,707,165 A | * | 11/1987 | Tauber | B01D 19/0057 210/108 |
| 5,103,793 A | * | 4/1992 | Riese | F02M 37/08 123/509 |
| 5,146,901 A | * | 9/1992 | Jones | F02M 25/0854 123/509 |
| 6,179,581 B1 | * | 1/2001 | Schnittger | F04C 15/0057 417/302 |
| 7,237,538 B2 | * | 7/2007 | Perruchot | F02M 37/106 123/509 |

(Continued)

FOREIGN PATENT DOCUMENTS

| | | |
|---|---|---|
| EP | 376443 | 7/1990 |
| EP | 844141 | 5/1998 |

OTHER PUBLICATIONS

Robert Bosch Corporation gasoline/E85 fuel delivery module part No. F00HK00420, known and accessible to the public at least prior to Aug. 27, 2011, as illustrated and described in the accompanying drawings and statement of relevance, 3 pages.

(Continued)

*Primary Examiner* — Marguerite McMahon
*Assistant Examiner* — James Kim
(74) *Attorney, Agent, or Firm* — Michael Best & Friedrich, LLP

(57) ABSTRACT

A diesel fuel pump module for use within a diesel fuel tank includes a reservoir defining a fuel storage volume. A jet pump having an inlet is positioned within the reservoir and configured to pump fuel from the tank into the reservoir. The module further includes an electric pump having an inlet and an outlet, and an air separation chamber connecting the electric pump outlet to the inlet of the jet pump.

20 Claims, 9 Drawing Sheets

(56) References Cited

U.S. PATENT DOCUMENTS

| | | | | |
|---|---|---|---|---|
| 7,401,599 | B2 * | 7/2008 | Saito | B01D 19/0052 123/518 |
| 7,713,335 | B2 | 5/2010 | Ringenberger et al. | |
| 8,360,740 | B2 * | 1/2013 | Leppert | F02M 37/10 123/509 |
| 8,459,235 | B2 * | 6/2013 | Achor | F02M 37/0011 123/198 D |
| 2001/0005986 | A1 | 7/2001 | Matsubara et al. | |
| 2003/0154860 | A1 * | 8/2003 | Milia | B01D 19/0057 95/261 |
| 2008/0098893 | A1 * | 5/2008 | Ringenberger | B67D 7/763 95/261 |
| 2009/0025693 | A1 | 1/2009 | Steinman et al. | |
| 2010/0202898 | A1 * | 8/2010 | Mason | F04F 5/10 417/151 |
| 2011/0239993 | A1 * | 10/2011 | Powell | F02M 37/106 123/497 |
| 2012/0137884 | A1 | 6/2012 | Steinman | |
| 2012/0247431 | A1 * | 10/2012 | Powell | F04B 23/021 123/497 |
| 2013/0306168 | A1 * | 11/2013 | Braun | F02M 37/22 137/544 |

OTHER PUBLICATIONS

Robert Bosch Corporation diesel fuel delivery module part No. 0580203024, known and accessible to the public at least prior to Aug. 27, 2011, as illustrated and described in the accompanying drawings and statement of relevance, 2 pages.

Robert Bosch Corporation diesel fuel delivery module part No. F00HK00555, known and accessible to the public at least prior to Aug. 27, 2011, as illustrated and described in the accompanying drawings and statement of relevance, 3 pages.

* cited by examiner

DIESEL FUEL PUMP MODULE

BACKGROUND

The present invention relates to a diesel fuel pump module for supplying diesel fuel from a vehicle fuel tank to a fuel rail for fuel injection.

SUMMARY

In one embodiment of a diesel fuel pump module for use within a diesel fuel tank, the fuel pump module includes a reservoir defining a fuel storage volume. A jet pump having an inlet is positioned within the reservoir and configured to pump fuel from the tank into the reservoir. The module further includes an electric pump having an inlet and an outlet, and an air separation chamber connecting the electric pump outlet to the inlet of the jet pump.

In one embodiment of a method of operating a jet pump, in which the jet pump has a nozzle and is operable to pump diesel fuel from a tank into a fuel pump module reservoir, the method includes generating from a diesel fuel mixture containing a first portion of gas, a diesel fuel mixture containing a second portion of gas, wherein the second portion of gas is greater than the first portion of gas. The method also includes supplying some of the diesel fuel mixture containing the second portion of gas to the jet pump.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. And as used herein and in the appended claims, the terms "upper", "lower", "top", "bottom", "front", "back", and other directional terms are not intended to require any particular orientation, but are instead used for purposes of description only.

Figure 1:
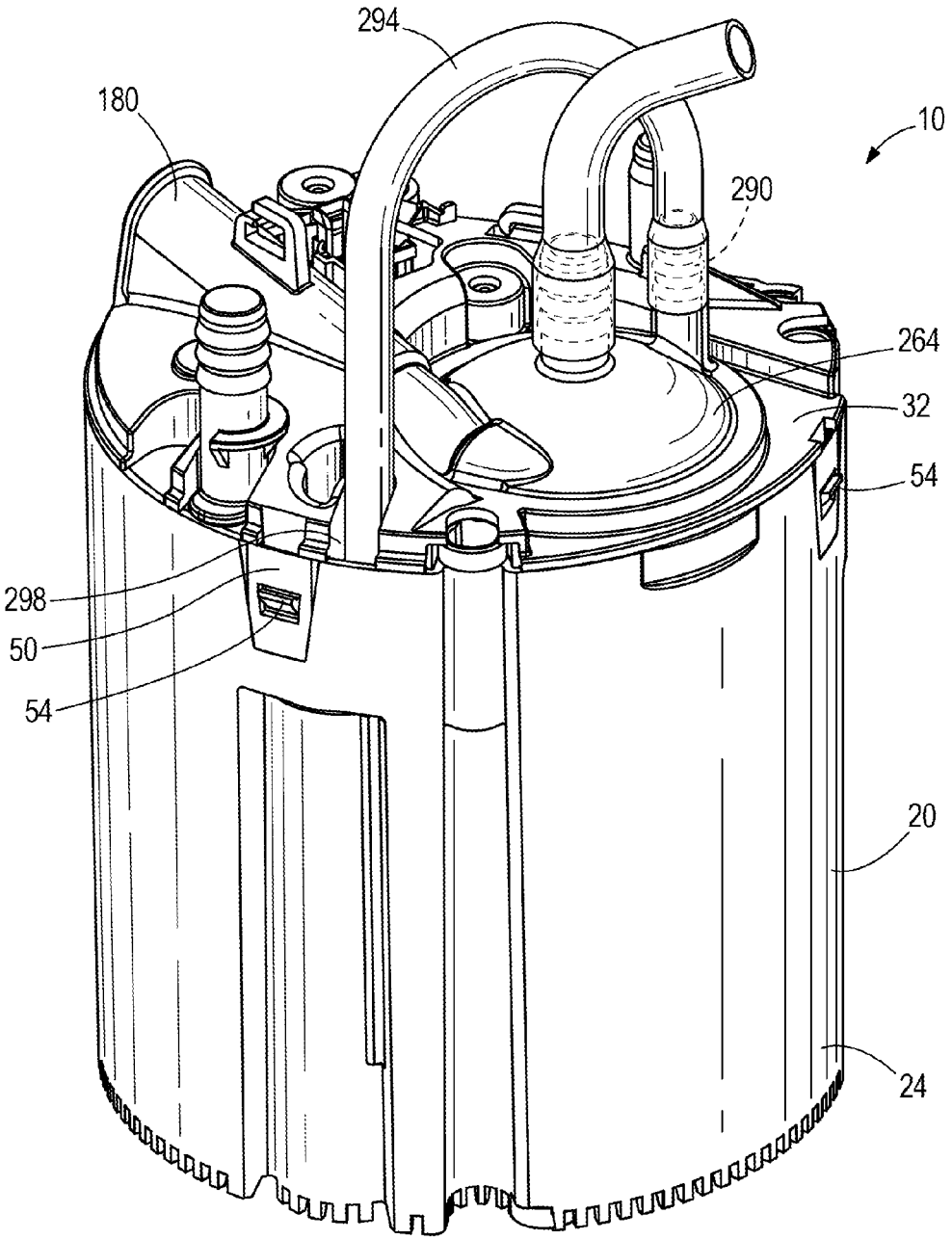
FIG. 1 is a perspective view of a diesel fuel pump module.
Figure 2:
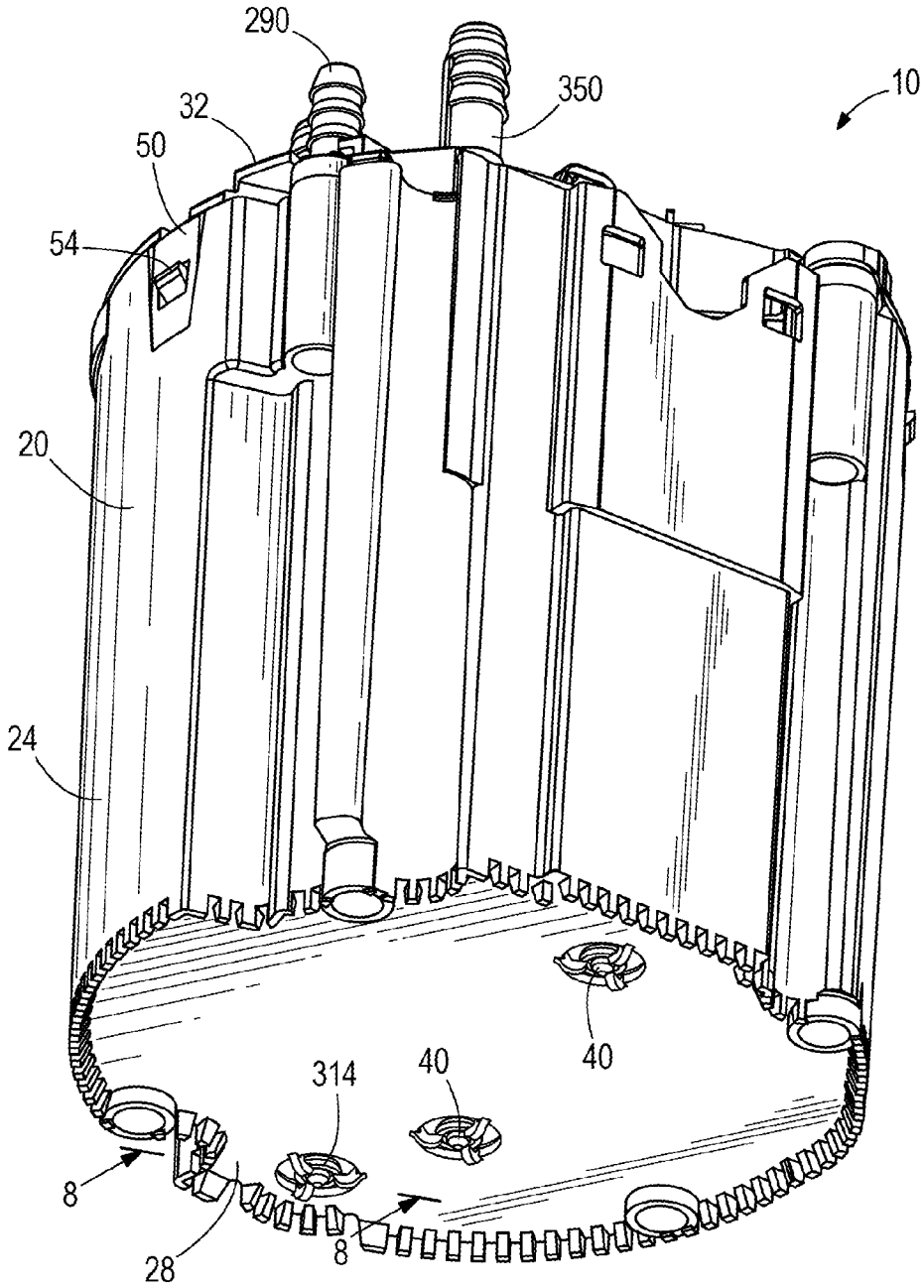
FIG. 2 is another perspective view of the diesel fuel pump module of FIG. 1.

FIGS. 1 and 2 illustrate a diesel fuel pump module 10 for supplying high pressure diesel fuel to a fuel injection system. The fuel pump module 10 is positioned inside a fuel tank (not shown) and transfers fuel from within the tank for further pressurization into a fuel rail for use by one or more fuel injectors of a diesel engine. The fuel pump module 10 includes a fuel reservoir 20 defining a fuel storage volume formed by a generally cylindrical reservoir vessel 24 with a flat bottom surface 28 and a mating reservoir cover 32. One or more one-way fill valves 40 are formed with the bottom surface 28 to permit initial filling of the vessel 24. A retention tab 50 integrally formed with or otherwise coupled to the vessel 24 snaps over a locking protrusion 54 on the cover 32 and secures the cover 32 to the vessel 24. The cover 32 does not form a tight seal with the vessel 24, but includes one or more gaps for communication between the fuel storage volume and the fuel tank. A plurality of ports transfer diesel fuel to, from, and within the fuel pump module 10, as will be further described below.

Figure 3:
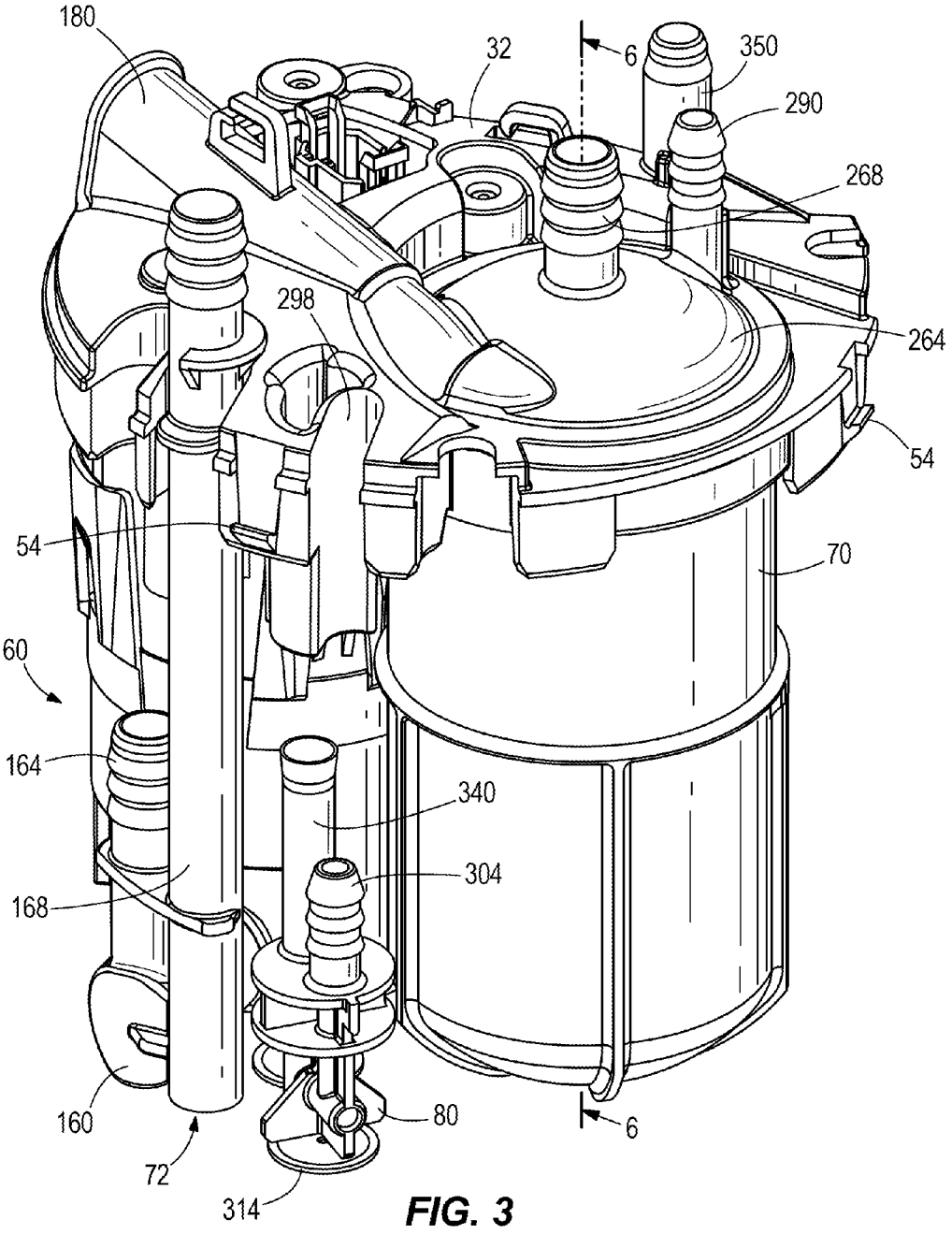
FIG. 3 is a perspective view of the diesel fuel pump module of FIG. 1 with the module vessel removed revealing a lower assembly.
Figure 4:
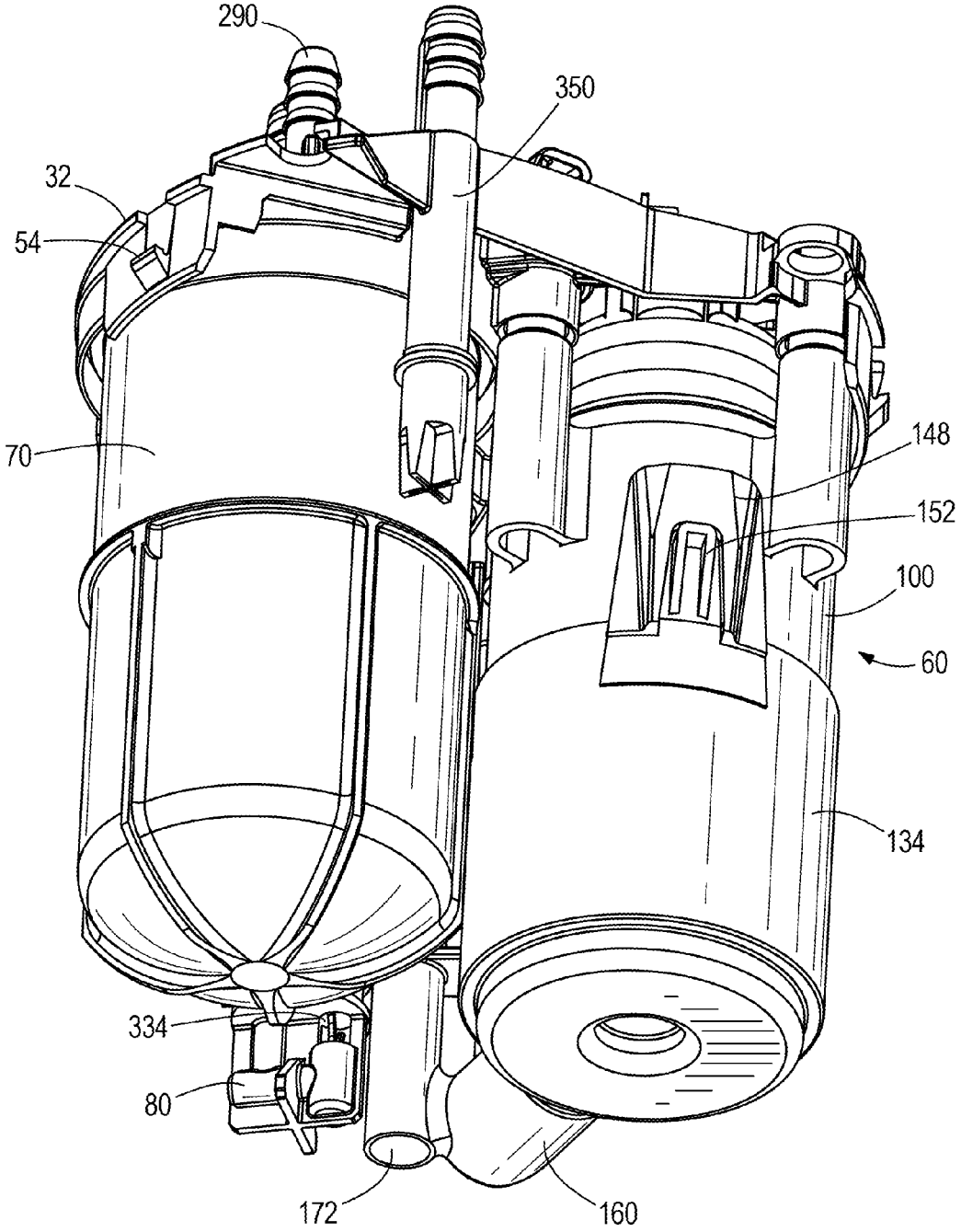
FIG. 4 is another perspective view of the diesel fuel pump module as illustrated in FIG. 3.
Figure 5:
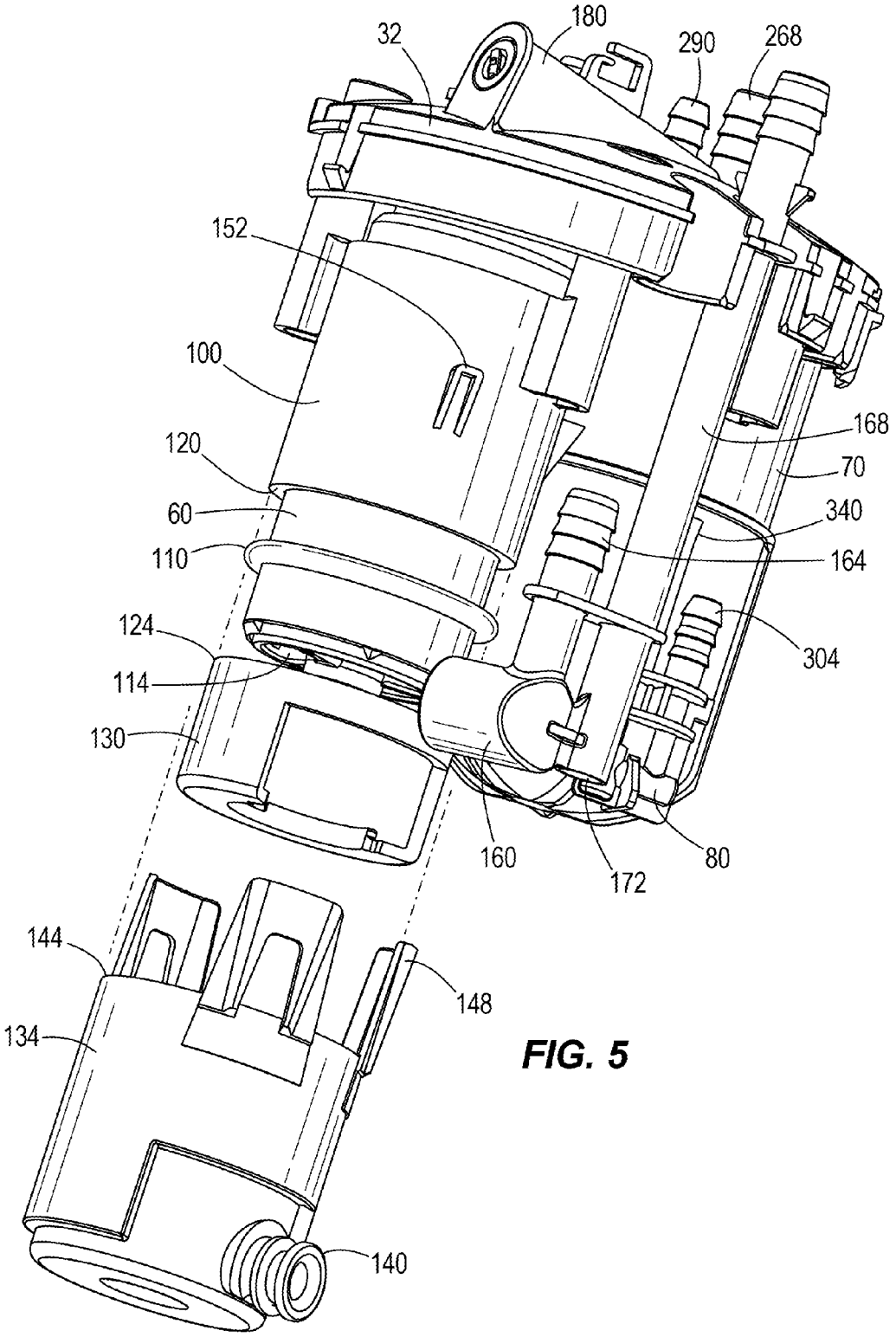
FIG. 5 is an exploded view of the diesel fuel pump module of FIG. 1 with the module vessel removed.

Referring to FIGS. 3, 4, and 5, the fuel pump module 10 is shown without the vessel 24, exposing a lower assembly of components, including a lift pump 60, an air separator 70, and a jet pump 80.

The illustrated lift pump 60 is an electric roller cell pump with a direct current drive and is positioned within a hanger 100 secured to the cover 32. An o-ring (FIG. 6) or other sealing member 110 disposed around a lower portion of the pump 60 seals the pump inlet 114 from the external environment and is sandwiched between a bottom edge 120 of the hanger 100 and a top edge 124 of an o-ring support member 130. A cylindrical pump fitting or cup 134 having an inlet port 140 and an upper surface 144 overlies the o-ring 110 and o-ring support member 130 when assembled. Retention tabs 148 extending from the upper surface 144 hook over radial protrusions 152 of the hanger 100 and affix the pump cup 134 in place. A pump inlet 160 sealingly mates with the inlet port 140 and includes a 90-degree turn from a barbed inlet connection 164. An external filter outlet conduit (not shown) fits onto the inlet connection 164 adjacent to a filter inlet conduit 168 with a fuel pick-up opening 172, the purpose of which will be further explained below.

Figure 6:
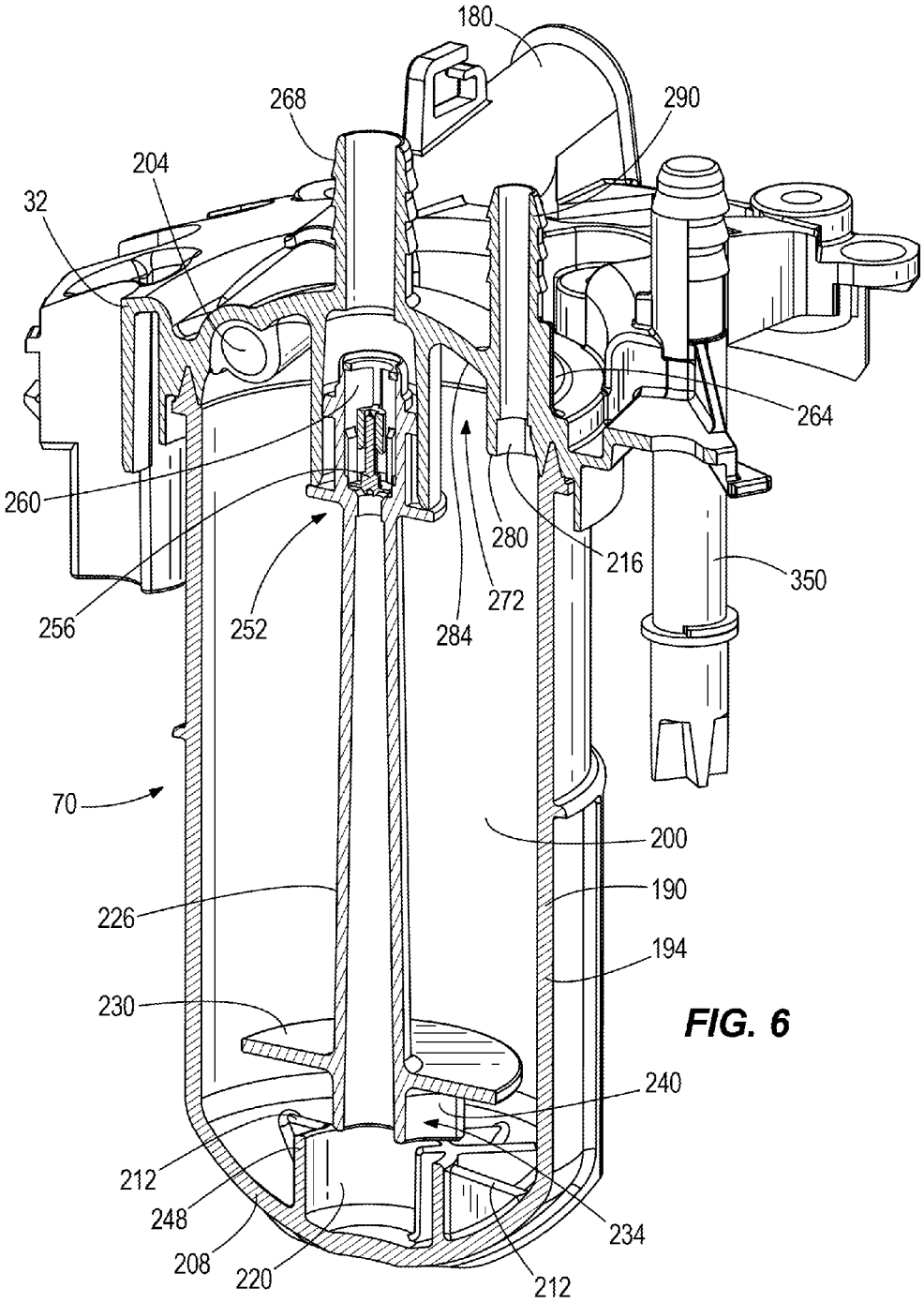
FIG. 6 is a cross sectional view of the diesel fuel pump module taken along line 6-6 of FIG. 3.
Figure 7:
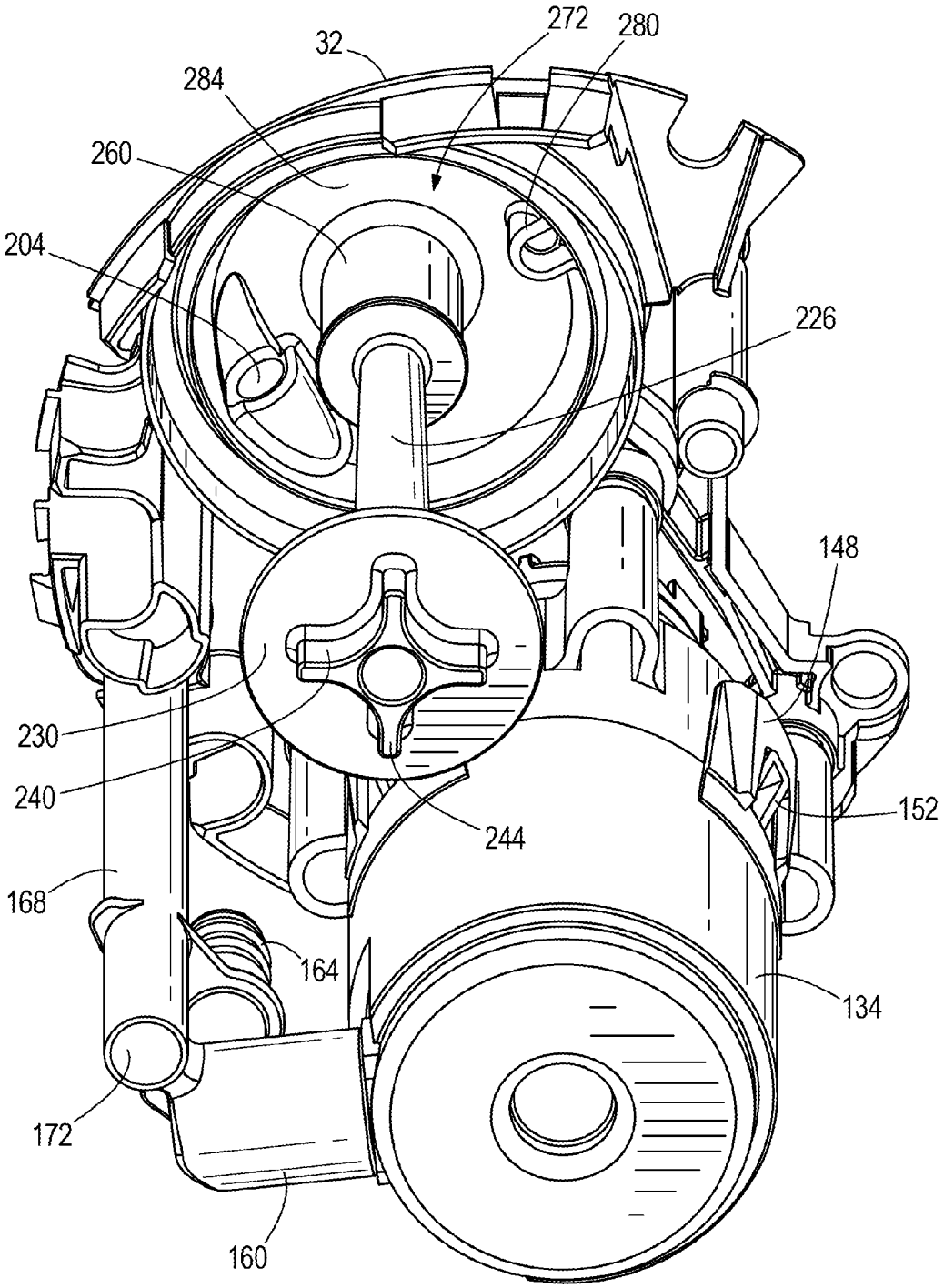
FIG. 7 is another perspective view of the diesel fuel pump module as illustrated in FIG. 3 with the air separation chamber removed.

The outlet of the lift pump 60 is in fluid communication through a channel 180 to the air separator 70. Referring also to FIG. 6, the air separator 70 comprises an air separator housing 190 with a cylindrical wall 194 defining a separation chamber 200. The channel 180 from the pump 60 ends in an opening 204 directed generally tangentially to the curvature of the wall 194. The hemispherical bottom 208 of the chamber 200 includes a plurality of equally spaced support ribs 212 about a central cavity 220. The central cavity 220 is in communication with a centrally disposed tube 226. A flattened member or disc 230 integrally formed near a first end 234 of the tube 226 extends radially a portion of the way to the wall 194. As shown also in FIG. 7, fins 240 extend radially toward the perimeter of the disc 230 and form a support surface 244 for contact between the tube 226 and the annular wall 248 defining the central cavity 220. As illustrated, the tube 226 tapers from the first end 234 at the bottom of the chamber 200 to a second end 252 near the top of the chamber 200, but in other embodiments may not include such a taper. The second end 252 exits to a check valve 256 positioned within an outlet region 260.

The top of the chamber 200 is defined by a dome 264 formed as part of the cover 32 and includes a barbed chamber outlet connection 268 in communication with the outlet region 260. The curvature of the dome 264 forms an annular pocket 272 about the outlet region 260. A separate opening 276 radially positioned near the wall 194 of the chamber 200 includes a first end 280 located below the inner surface 284 of the dome 264 and fluidly couples the chamber 200 to a barbed connection 290.

Figure 8:
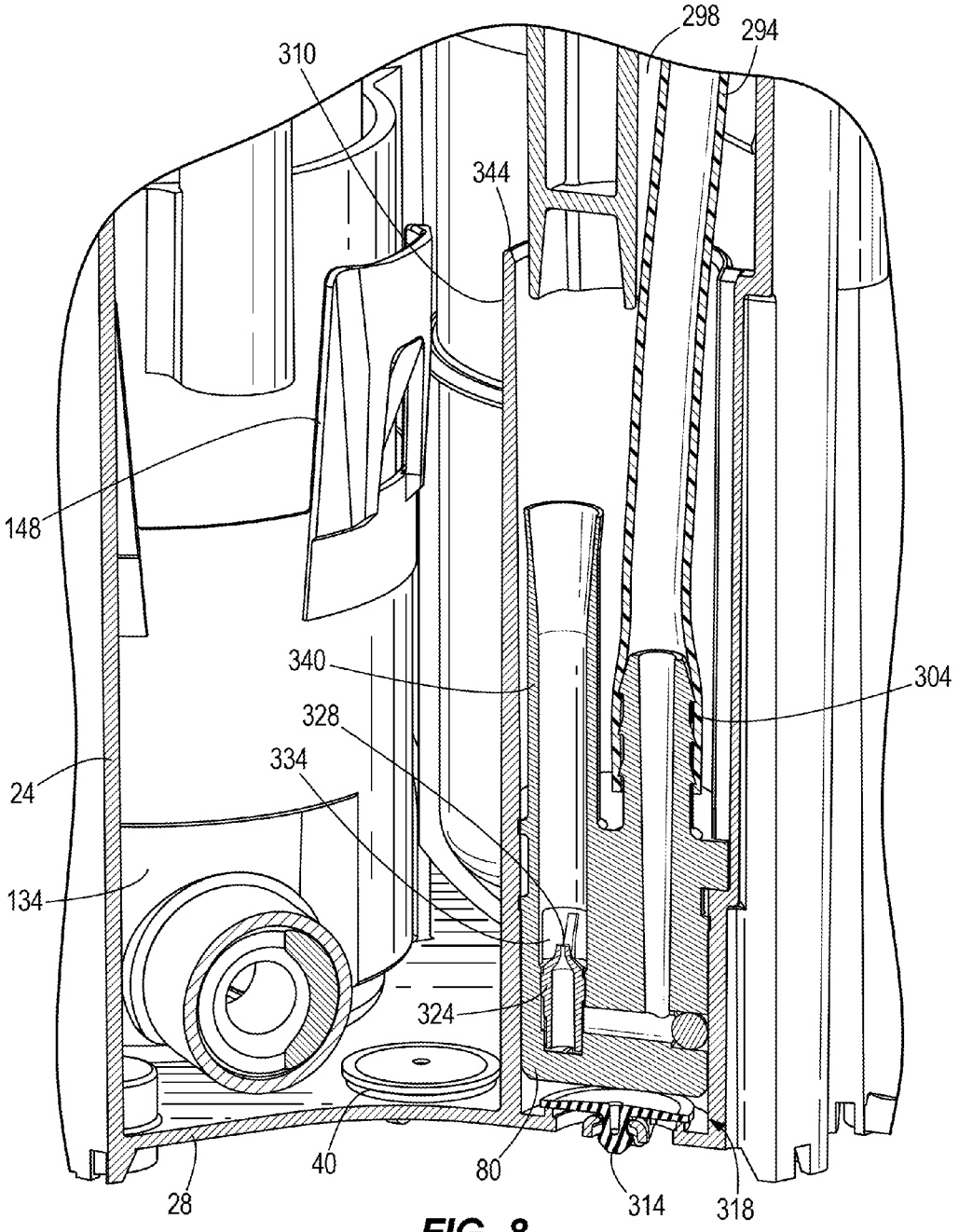
FIG. 8 is a partial cross sectional view of the diesel fuel pump module taken along line 8-8 of FIG. 2.

Referring again to FIG. 1, a transfer tube 294 extends from the barbed connection 290, over the dome 264, and back into a recess 298 in the cover 32. Referring also to FIGS. 3, 4, and 8, the tube 294 can be a corrugated flexible tube and extends to a barbed connection 304 leading to the jet pump 80 situated in a lift pipe 310. An inlet check valve 314 seated at the bottom surface 28 seals a lower region 318 of the lift pipe 310 from the tank contents. The jet pump 80 includes a nozzle 324 with an outlet orifice 328 positioned within an opening 334 directed to an outlet tube 340 within the lift pipe 310. The outlet tube 340 opens near the edge 344 of the lift pipe 310 within the fuel storage volume at a point closer to the cover 32 than the pick-up opening 172 of the filter inlet conduit 168. As shown in FIGS. 3 and 4, a separate high pressure return tube 350 with a barbed connection fluidly couples the fuel rail to the reservoir 20, and may include a check valve (not shown) within the vessel 24.

Figure 9:
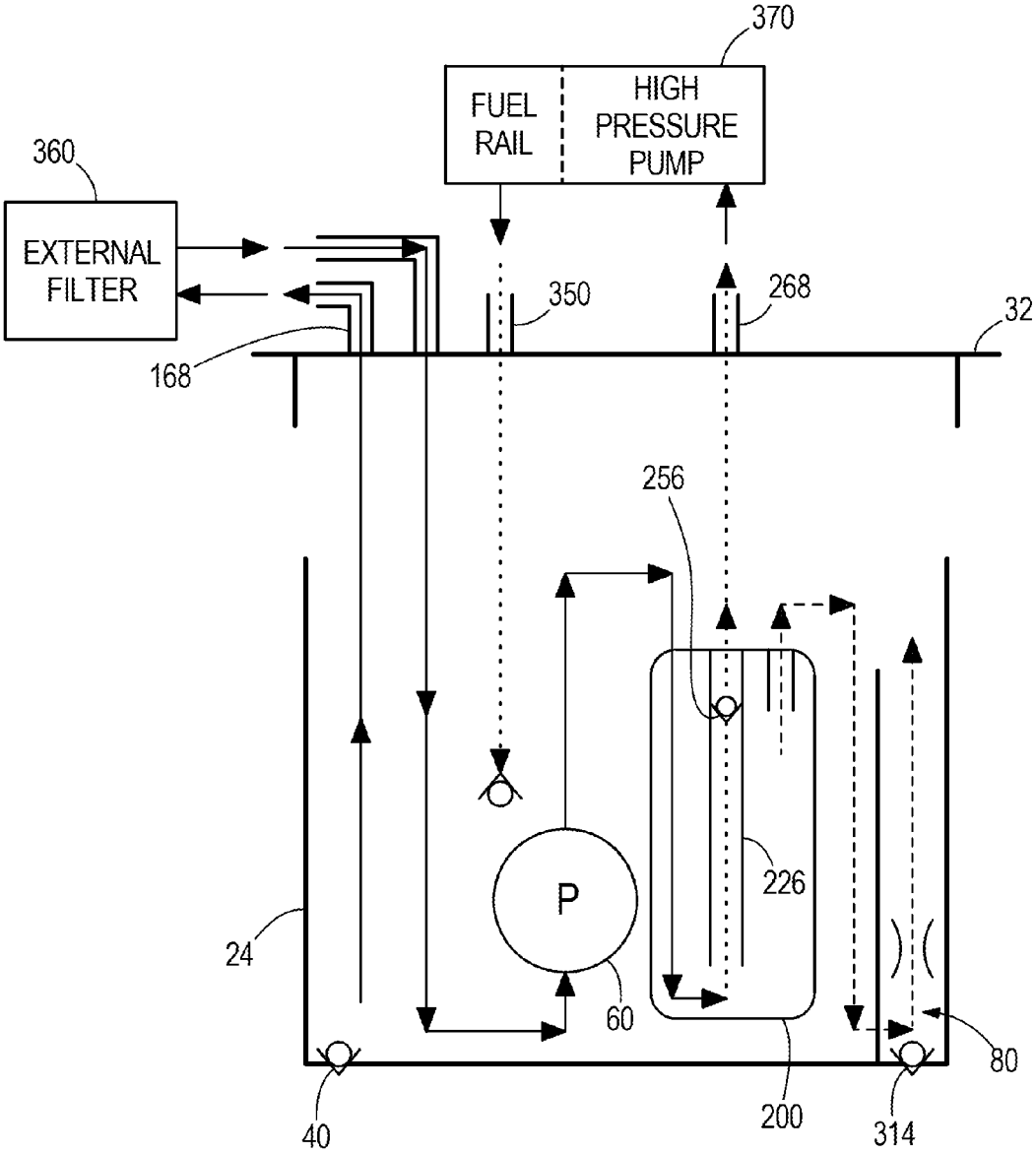
FIG. 9 is a flow diagram of the fuel flow within the diesel fuel pump module of FIG. 1

Referring also to FIG. 9, with the fuel pump module 10 positioned within a diesel fuel tank, in operation, when fuel is needed for the fuel rail, a control algorithm (not detailed herein) activates the lift pump 60. The pump 60 creates a low-pressure area to draw in fuel at the pump inlet 114. Because the inlet 114 is sealed from the immediate fuel storage volume by the o-ring 110, fuel is drawn through the pick-up opening 172 and flows through the inlet conduit 168 out of the vessel 24 to an external filter 360. In one embodiment, the external filter 360 is a long-life filter constructed of a hydroscopic filter media that functions to separate water from the diesel fuel before it enters the lift pump 60. The fuel passes through the filter 360, reenters the vessel 24, and flows through the filter outlet conduit to the inlet port 140 of the pump cup 134. The fuel enters the inlet port 140 of the pump cup 134 and is pressurized by the lift pump 60 to a differential of approximately 4 atmospheres. This pressurized fuel flows through the channel 180 to the air separator 70.

The fuel passing through the channel 180 is introduced into the separation chamber 200 with a velocity generally tangential to the chamber wall 194. The fuel, which is a mixture of fuel, air, and fuel vapor, flows in a gravity-assisted at least partial helical pattern from the top of the chamber 200 towards the bottom 208, viewed from the perspective of FIG. 6. As the fuel travels downward, the inertia of the higher density liquid fuel tends to direct liquid fuel closer to the chamber wall 194 while lighter air and fuel vapor remain near the center of the chamber 200. As the denser liquid fuel flows downward to the central cavity 220, any remaining swirling motion of this fuel is impeded upon contact with the disk 230. The liquid fuel flows past the fins 212, collects in the cavity 220, and, due to the pressure differential in the system generated by the lift pump 60, flows upward within the tube 226. The check valve 256 ensures that liquid fuel flows only in a direction from the tube 226 to the outlet region 260 and out of the chamber 220.

From the outlet region 260, the "cleaner" fuel, at or near 100% liquid, flows to a pressurization pump 370 outside of the tank, within which it is pressurized to the proper pressure required by the fuel rail for use in the fuel injection system. Because diesel fuel has a tendency to foam when agitated and the gas bubbles formed do not necessarily quickly dissipate, the air separation chamber 200 removes a significant portion of these gas bubbles from the fuel, which can cause noises within the pressurization pump 370 if not reduced prior to entry. The air separator 70 thus generates from a diesel fuel mixture containing a first portion of gas, 1) a diesel fuel mixture containing a second portion of gas that is greater than the first portion of gas and therefore more compressible and 2) a diesel fuel mixture containing a third portion of gas that is less than the first portion of gas. As an example, the air separator 70 may generate from a diesel fuel mixture that is approximately 99% liquid and 1% gas or vapor by volume, 1) a diesel fuel mixture that is 2% or more gas or vapor by volume and 2) a diesel fuel mixture that is at or near 100% liquid diesel fuel.

Fuel within the fuel rail that is not injected through one or more fuel injectors is recycled back to the reservoir 20 through the high pressure return tube 350.

The lower density fuel mixture consisting of fuel, air, and vapor near the center of the chamber 200 rises conically toward the dome 264. A portion of this lower density mixture is retained within the annular pocket 272 adjacent the dome 264 and the outlet region 260 and provides a volume of compressible fluid that serves to dampen any pressure pulsations within the chamber 200, in turn lessening any noise produced from the fuel pump module 10.

Some of this compressible fuel mixture flows to the opening 276 and passes through the transfer tube 294 to provide the motive force for the jet pump 80. This portion enters the inlet of the jet pump 80 and is directed to the nozzle 324, from which it leaves at a higher velocity through the orifice 328. The stream of the fuel mixture exiting the orifice 328 is positioned in the opening 334 and, due to the configuration of the lift pipe 310 surrounding the jet pump 80, pulls in fuel from within the tank through the check valve 314. This fuel passes through the check valve 314 and into the lower region 318, from where it is entrained in the jet pump stream. The mix of flow from the stream and entrained fuel from the tank continues through the outlet tube 340 where it exits into the reservoir 20 near the top of the lift pipe 310. Once initially primed, the jet pump 80 maintains the reservoir 20 full of fuel, with excess fuel able to flow out of the gap(s) between the cover 32 and the vessel 24 and into the tank.

Various features and advantages of the invention are set forth in the following claims.

What is claimed is:

1. A diesel fuel pump module comprising:

a reservoir defining a fuel storage volume;

a jet pump positioned within the reservoir and configured to pump fuel from the tank into the reservoir, the jet pump including an inlet;

an electric pump having an inlet and an outlet; and an air separation chamber connecting the electric pump outlet to the inlet of the jet pump.

2. The fuel pump module of claim 1, wherein the jet pump includes a nozzle, and wherein the air separation chamber includes an outlet port in fluid communication with the nozzle.

3. The fuel pump module of claim 2, wherein the outlet port of the air separation chamber is a first outlet port, and wherein the air separation chamber includes a second outlet port.

4. The fuel pump module of claim 1, wherein the air separation chamber is configured to receive a flow of diesel fuel and to generate within the air separation chamber a flow of liquid fuel and a fluid mixture more compressible than the liquid fuel.

5. The fuel pump module of claim 4, wherein a portion of the air separation chamber is configured to retain a portion of the fluid mixture.

6. The fuel pump module of claim 4, further comprising a tube entirely contained within the air separation chamber and configured to direct the flow of liquid fuel out of the air separation chamber.

7. The fuel pump module of claim 1, further comprising a channel connecting the outlet of the electric pump to the air separation chamber.

8. The fuel pump module of claim 1, wherein the module further includes a fitting couplable to the electric pump and operable with a sealing member on the pump to seal the electric pump inlet from the fuel storage volume.

9. The fuel pump module of claim 1, wherein the electric pump is a roller cell pump.

10. A method of operating a jet pump, the jet pump having a nozzle and operable to pump diesel fuel from a tank into a fuel pump module reservoir, the method comprising:

from a diesel fuel mixture containing a first portion of gas, generating a diesel fuel mixture containing a second portion of gas, wherein the second portion of gas by volume within the diesel fuel mixture containing the second portion of gas is greater than the first portion of gas by volume within the diesel fuel mixture containing the first portion of gas; and supplying some of the diesel fuel mixture containing the second portion of gas to the jet pump.

11. The method of claim 10, wherein supplying the diesel fuel mixture containing the second portion of gas to the jet pump includes supplying the diesel fuel mixture containing the second portion of gas to a nozzle of the jet pump.

12. The method of claim 10, further comprising passing the diesel fuel mixture containing a first portion of gas through a filter prior to the generating step, wherein the filter is external to the fuel pump module reservoir.

13. The method of claim 10, further comprising pumping with a roller cell pump the diesel fuel mixture containing a first portion of gas into a separation chamber, wherein the generating is performed within the separation chamber.

14. The method of claim 13, further comprising effecting helical flow of the diesel fuel mixture containing a first portion of gas within the separation chamber.

15. The method of claim 13, further comprising directing some of the diesel fuel mixture containing the second portion of gas from the separation chamber to the jet pump.

16. The method of claim 13, further comprising retaining some of the diesel fuel mixture containing the second portion of gas within the separation chamber.

17. The method of claim 13, further comprising admitting diesel fuel from the tank into the fuel pump module reservoir as a result of directing some of the diesel fuel mixture containing the second portion of gas from the separation chamber to the jet pump.

18. The method of claim 13, further comprising retaining some of the diesel fuel mixture containing the second portion of gas within the separation chamber adjacent separated fuel having a third portion of gas by volume less than the first portion.

19. The method of claim 18, further comprising passing the fuel having a third portion of gas less than the first portion out of the separation chamber to a fuel injector.

20. The method of claim 18, further comprising passing some of the fuel mixture having a second portion of gas greater than the first portion out of the separation device to a jet pump.

* * * * *